US007726392B1

(12) United States Patent
Robertson

(10) Patent No.: US 7,726,392 B1
(45) Date of Patent: Jun. 1, 2010

(54) REMOVAL OF DOWNHOLE DRILL COLLAR FROM WELL BORE

(76) Inventor: Michael C. Robertson, P.O. Box 151748, Arlington, TX (US) 76015

( * ) Notice: Subject to any disclaimer, the term of this patent is extended or adjusted under 35 U.S.C. 154(b) by 59 days.

(21) Appl. No.: 12/055,428

(22) Filed: Mar. 26, 2008

(51) Int. Cl.
*E21B 29/00* (2006.01)

(52) U.S. Cl. ..... 166/55; 166/58; 166/59; 166/297

(58) Field of Classification Search ..... 166/55, 166/297, 298, 301, 58, 59; 83/54
See application file for complete search history.

(56) References Cited

U.S. PATENT DOCUMENTS

| | | | | |
|---|---|---|---|---|
| 2,037,938 | A | 4/1936 | Spencer | |
| 2,037,955 | A | 4/1936 | Wells | |
| 2,842,207 | A * | 7/1958 | Alexander | 166/301 |
| 2,958,512 | A | 11/1960 | Humphrey | |
| 3,047,313 | A | 7/1962 | Bruce | |
| 3,167,137 | A | 1/1965 | Humphrey | |
| 4,278,127 | A | 7/1981 | Rankin | |
| 4,428,430 | A | 1/1984 | Terrell et al. | |
| 4,598,769 | A | 7/1986 | Robertson | |
| 4,889,187 | A | 12/1989 | Terrell et al. | |
| 5,320,174 | A | 6/1994 | Terrell et al. | |
| 5,435,394 | A | 7/1995 | Robertson | |
| 5,509,480 | A | 4/1996 | Terrell et al. | |
| 5,636,692 | A | 6/1997 | Haugen | |
| 5,709,265 | A | 1/1998 | Haugen et al. | |
| 5,720,344 | A * | 2/1998 | Newman | 166/253.1 |
| 5,791,417 | A | 8/1998 | Haugen et al. | |
| 6,186,226 | B1 | 2/2001 | Robertson | |
| 6,598,679 | B2 | 7/2003 | Robertson | |
| 6,712,143 | B2 | 3/2004 | Robertson | |
| 6,722,435 | B2 | 4/2004 | DeGeare | |
| 6,925,937 | B2 | 8/2005 | Robertson | |
| 6,971,449 | B1 * | 12/2005 | Robertson | 166/297 |

* cited by examiner

*Primary Examiner*—David J Bagnell
*Assistant Examiner*—Kipp C Wallace
(74) *Attorney, Agent, or Firm*—The Matthews Firm

(57) ABSTRACT

A drill string in a borehole can be cut at the drill collars. A torch is lowered into the drill string and positioned at a joint of the drill collar string. The joint has a pin component and a box component. The torch has one or more openings in the pattern of a vertical slot. The torch is ignited and the pin component is cut in a direction along the length of the drill string. The joint uncoupled, even though the box component need not be cut. The uncoupling of the joint effectively cuts the drill string at the joint.

6 Claims, 5 Drawing Sheets

REMOVAL OF DOWNHOLE DRILL COLLAR FROM WELL BORE

FIELD OF THE INVENTION

The present invention relates to methods for removing drill collars from well bores.

BACKGROUND OF THE INVENTION

In oil and gas wells, a drill string is used to drill a well bore into the earth. The drill string is typically a length of drill pipe extending from the surface into the well bore. The bottom end of the drill string has a drill bit.

In order to increase the effectiveness of drilling, weight in the form of one or more drill collars is included in the drill string. A string of drill collars is typically located just above the drill bit and its sub. The string of drill collars contains a number of drill collars. A drill collar is similar to drill pipe in that it has a passage extending from one end to the other for the flow of drilling mud. The drill collar has a wall thickness around the passage; the wall of a drill collar is typically much thicker than the wall of comparable drill pipe. This increased wall thickness enables the drill collar to have a higher weight per foot of length than comparable drill pipe.

During drilling operations, the drill string may become stuck in the hole. If the string cannot be removed, then the drill string is cut. Cutting involves lowering a torch into the drill string and physically severing the drill string in two, wherein the upper part can be removed for reuse in another well bore. The part of the drill string located below the cut is left in the well bore and typically cannot be retrieved or reused. Cutting is a salvage operation. A particularly effective cutting tool is my radial cutting torch described in U.S. Pat. No. 6,598,679.

The radial cutting torch produces combustion fluids that are directed radially out to the pipe. The combustion fluids are directed out in a complete circumference so as to cut the pipe all around the pipe circumference.

It is desired to cut the drill string as close as possible to the stuck point, in order to salvage as much of the drill string as possible. Cutting the drill string far above the stuck point leaves a section of retrievable pipe in the hole.

If, for example, the drill bit or its sub is stuck, then in theory one of the drill collars can be cut to retrieve at least part of the drill collar string. Unfortunately, cutting a drill collar, with its thick wall, is difficult. It is much easier to cut the thinner wall drill pipe located above the drill collars. Consequently, the drill collar string may be left in the hole, as the drill string is cut above the drill collar.

It is desired to cut a drill collar for retrieval purposes.

SUMMARY OF THE INVENTION

The present invention provides a method of severing a drill collar string, which drill collar string forms part of a stuck drill string in a borehole. A torch is lowered into the drill string. The torch is positioned at a joint in the drill collar string. The torch is ignited so as to produce cutting fluids. The cutting fluids are directed into the joint in a direction that is along the length of the drill collar string so as to cut the joint and allow the joint to unwind.

In accordance with one aspect of the present invention, the step of positioning the torch at a joint in the drill collar string further comprises the step of positioning cutting fluid openings of the torch at the joint.

In accordance with still another aspect of the present invention, the step of directing the cutting fluids into the joint further comprises producing a pattern of cutting fluids, the pattern having a length at least as long as the joint.

In accordance with still another aspect of the present invention, the joint further comprises a pin component on an inside diameter and a box component on an outside diameter. The pin component is severed while leaving the box component unsevered.

In accordance with still another aspect of the present invention, the portion of the drill collar string that is above the cut joint is removed from the borehole.

In accordance with still another aspect of the present invention, the cut end of the drill collar with the cut joint is redressed so as to make a new, uncut joint.

DESCRIPTION OF THE PREFERRED EMBODIMENT

Figure 4:
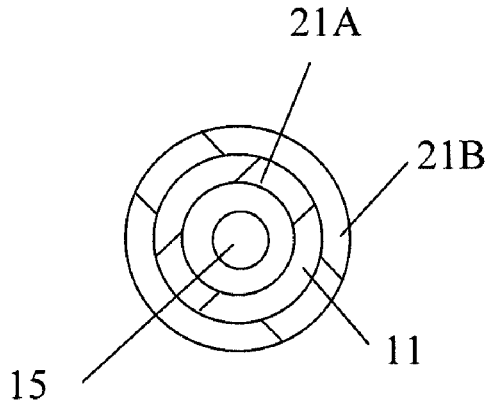
FIG. 4 is a cross-sectional view of FIG. 1, taken along lines IV-IV.

The present invention cuts a drill collar 11 (see FIGS. 1 and 4) in a well 12, thereby enabling the retrieval and future reuse of some or most of the drill collar string. The present invention utilizes a cutting torch 15 lowered down inside of the drill string 17. A torch is positioned at one of the joints 21 of one of the drill collars. The joints are high torque couplings.

Figure 2:
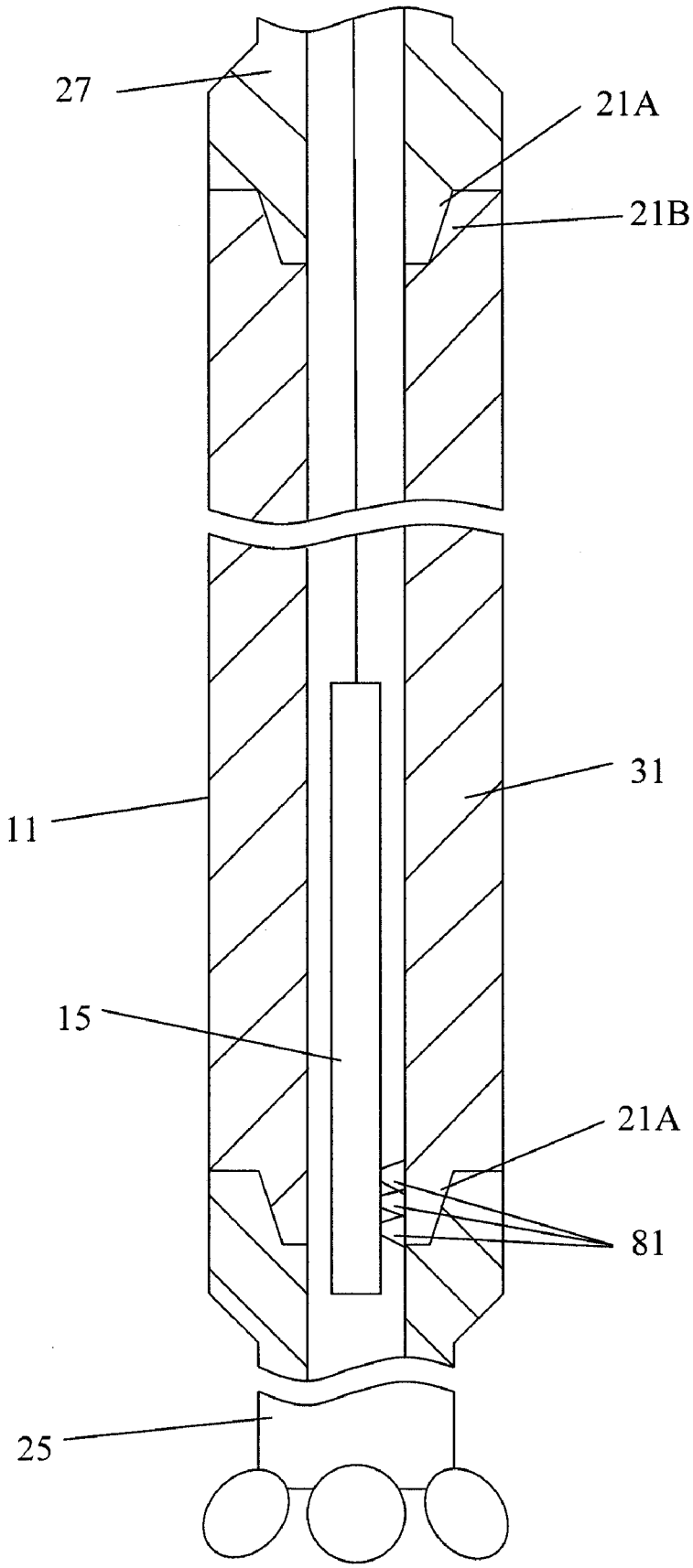
FIG. 2 is the same as FIG. 1, but the torch has been ignited.

When the torch 15 is ignited (see FIG. 2), it produces combustion fluids 81. The combustion fluids form a longitudinal slice or cut 23 through the coupling 21. This is different than conventional cutting, techniques that cut a pipe all around its circumference. The longitudinal cut effectively splits the coupling (see FIGS. 3 and 5). Because the coupling is under high torque before being cut, after being cut it unwinds and decouples. Thus, a relatively small amount of cutting energy can effectively cut a thick walled drill collar 11. The portion of the drill collar string that is decoupled is retrieved.

The present invention will be discussed now in more detail. First, a drill collar 11 will be discussed, followed by a description of the torch 15 and then the cutting operation will be discussed.

Figure 1:
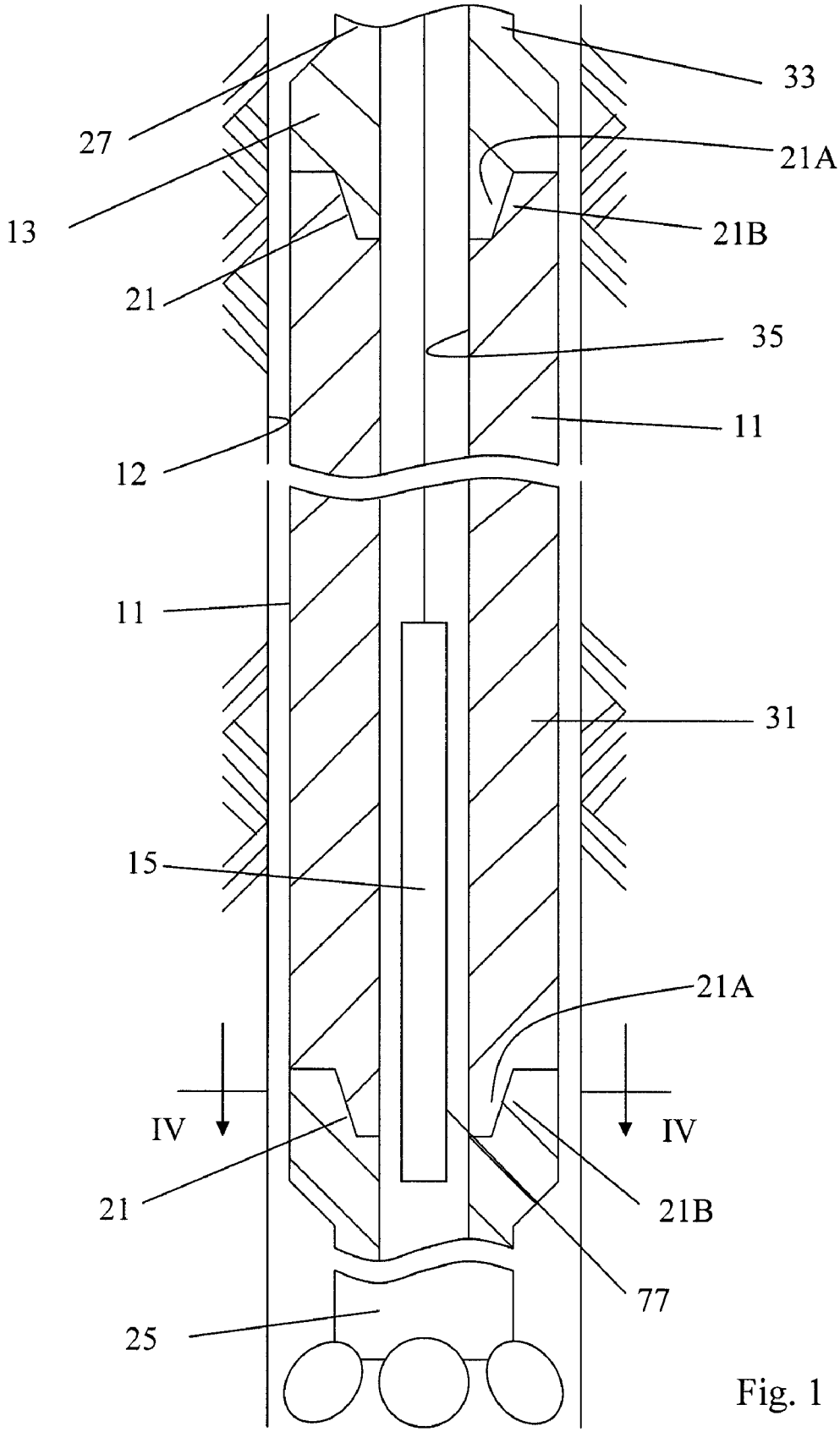
FIG. 1 is a cross-sectional view of a borehole with an uncut drill collar and a torch.

Referring to FIG. 1, the drill collar 11 is part of a drill string 13 that is located in a well 12 or borehole. The drill string 13 typically has a bottom hole assembly made up of a drill bit 25 and its sub and one or more drill collars 11. There may be other components such as logging while drilling (LWD) tools, measuring while drilling (MWD) tools and mud motors. Drill pipe 27 extends from the bottom hole assembly up to the surface. The drill string may have transition pipe, in the form of heavy weight drill pipe between the drill collars and the drill pipe. The drill string forms a long pipe, through which fluids, such as drilling mud, can flow.

The various components of the drill string are coupled together by joints. Each component or length of pipe has a coupling or joint at each end. Typically, a pin joint is provided at the bottom end, which has a male component, while a box joint is provided at the upper end, which has a female component. For example, as shown in FIG. 1, the lower joint of a drill collar 11 is a pin joint 21A, while the upper joint 21B is a box joint.

As illustrated in FIG. 1, the drill collar 11 is a heavy or thick walled pipe. The thickness of the drill collar wall 31 is greater than the thickness of the drill pipe wall 33. A passage 35 extends along the length of the drill collar, between the two ends.

The wall thickness of the pin joint 21A is less than the thickness of the wall 31 of the drill collar portion that is located between the two ends. Typical dimensions of the pin joint are 4 inches in length and ½ to 1 inch in wall thickness. The pin joint is tapered to fit into the similarly tapered box joint 21B.

The joints or couplings in the drill string and particularly in the drill collars are tight due to drilling. During drilling, the drill string 13 is rotated. This rotation serves to tighten any loose couplings. Consequently, the joints are under high torque.

Figure 6:
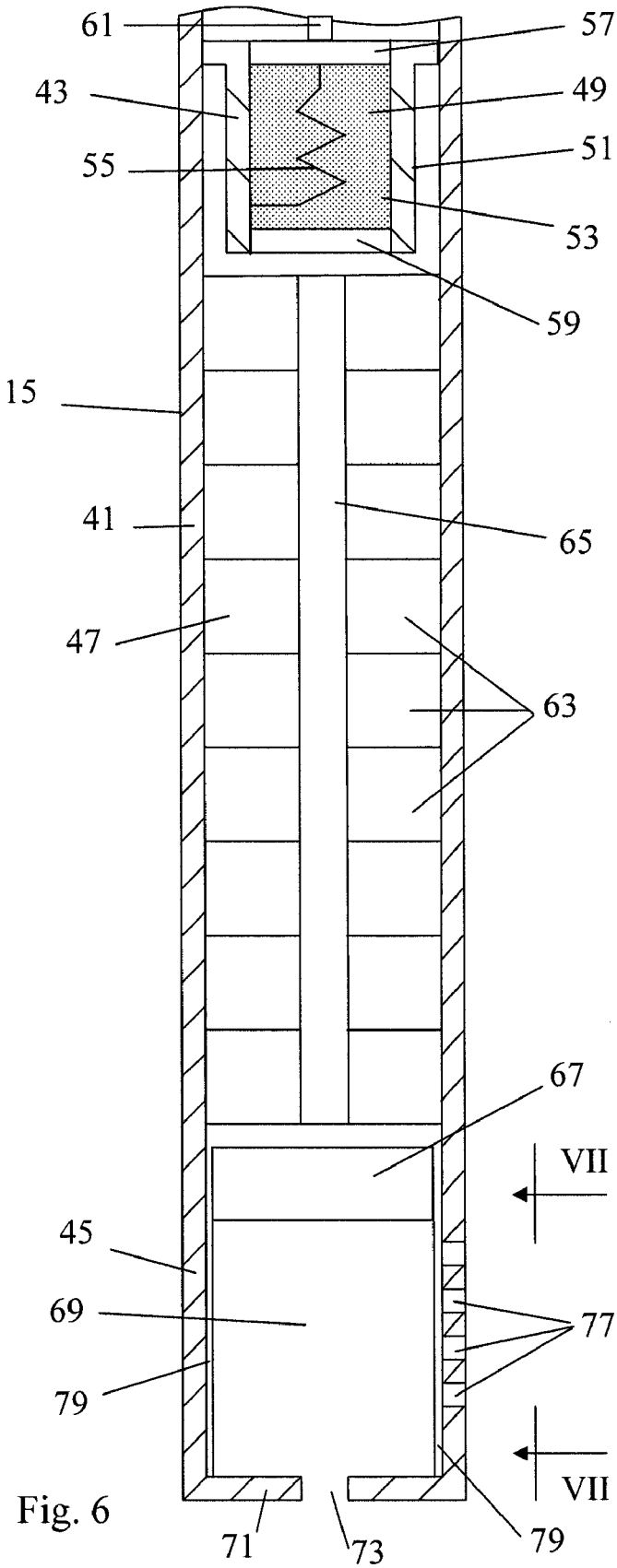
FIG. 6 is a longitudinal cross-sectional view of the torch.

The cutting torch 15 is shown in FIG. 6. The torch 15 has an elongated tubular body 41 which body has an ignition section 43, a nozzle section 45 and a fuel section 47 intermediate the ignition and fuel sections. In the preferred embodiment, the tubular body is made of three components coupled together by threads. Thus, the fuel section 47 is made from an elongated tube or body member, the ignition section 43 is made from a shorter extension member and the nozzle section 45 is made from a shorter head member.

The ignition section 43 contains an ignition source 49. In the preferred embodiment, the ignition source 49 is a thermal generator, previously described in my U.S. Pat. No. 6,925,937. The thermal generator 49 is a self-contained unit that can be inserted into the extension member. The thermal generator 49 has a body 51, flammable material 53 and a resistor 55. The ends of the tubular body 51 are closed with an upper end plug 57, and a lower end plug 59. The flammable material 53 is located in the body between the end plugs. The upper end plug 57 has an electrical plug 61 or contact that connects to an electrical cable (not shown). The upper plug 57 is electrically insulated from the body 51. The resistor 55 is connected between the contact 61 and the body 51.

The flammable material 53 is a thermite, or modified thermite, mixture. The mixture includes a powered (or finely divided) metal and a powdered metal oxide. The powdered metal includes aluminum, magnesium, etc. The metal oxide includes cupric oxide, iron oxide, etc. In the preferred embodiment, the thermite mixture is cupric oxide and aluminum. When ignited, the flammable material produces an exothermic reaction. The flammable material has a high ignition point and is thermally conductive. The ignition point of cupric oxide and aluminum is about 1200 degrees Fahrenheit. Thus, to ignite the flammable material, the temperature must be brought up to at least the ignition point and preferably higher. It is believed that the ignition point of some thermite mixtures is as low as 900 degrees Fahrenheit.

The fuel section 47 contains the fuel. In the preferred embodiment, the fuel is made up of a stack of pellets 63 which are donut or toroidal shaped. The pellets are made of a combustible pyrotechnic material. When stacked, the holes in the center of the pellets are aligned together; these holes are filled with loose combustible material 65, which may be of the same material as the pellets. When the combustible material combusts, it generates hot combustion fluids that are sufficient to cut through a pipe wall, if properly directed. The combustion fluids comprise gasses and liquids and form cutting fluids.

The pellets 65 are adjacent to and abut a piston 67 at the lower end of the fuel section 47. The piston 67 can move into the nozzle section 45.

The nozzle section 45 has a hollow interior cavity 69. An end plug 71 is located opposite of the piston 67. The end plug 71 has a passage 73 therethrough to the exterior of the tool. The side wall in the nozzle section 45 has one or more openings 77 that allow communication between the interior and exterior of the nozzle section. The nozzle section 45 has a carbon sleeve 79 liner, which protects the tubular metal body. The liner 75 is perforated at the openings 77.

Figure 7:
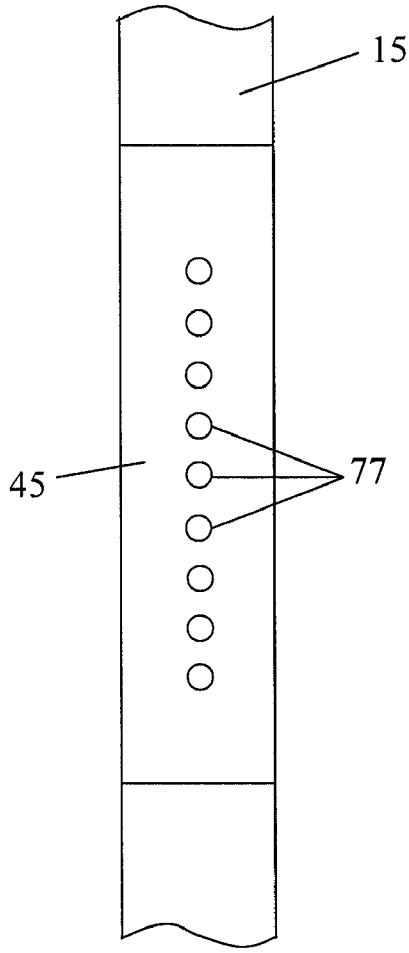
FIG. 7 is a side elevational view of the nozzle pattern of the torch, taken along lines VII-VII of FIG. 6.

The openings are arranged so as to direct the combustion fluids in a longitudinal manner. In the embodiment shown in FIG. 7, the openings 77 are arranged in a vertical alignment. The openings 77 can be rectangular in shape, having a height greater than a width. Alternatively, the openings can be square or circular (as shown). In another embodiment, the nozzle section 45 can have a single, elongated, vertical, slot-type opening.

The piston 67 initially is located so as to isolate the fuel 63 from the openings 77. However, under the pressure of combustion fluids generated by the ignited fuel 63, the piston 67 moves into the nozzle section 45 and exposes the openings 77 to the combustion fluids. This allows the hot combustion fluids to exit the tool through the openings 77.

The method will now be described. Referring to FIG. 1, the torch 15 is lowered into the drill string 13, which drill string is stuck. Before the torch is lowered, the decision has been made to cut the drill string and salvage as much of the drill string as possible. Also, the drill string is stuck at a point along the drill collar string or below the drill collar string.

The torch 15 can be lowered on a wireline, such as an electric wireline. The torch is positioned inside of the drill collar 11 which is to be cut. Specifically, the openings 77 are located at the same depth of the pin coupling 21A which is to be cut. The length of the arrangement of openings is longer than the pin joint. The longer the arrangement of openings, the less precision is required when positioning the torch relative to the pin joint 21A. Then, the torch is ignited. An electrical signal is provided to the igniter 49 (see FIG. 6), which ignites the fuel 65, 63. The ignited fuel produces hot combustion fluids. The combustion fluids 81 produced by the fuel force the piston 67 down and expose the openings 77. The combustion fluids 81 are directed out of the openings 77 and into the pin coupling 21A (see FIG. 2). The combustion fluids are directed in a pattern that is longitudinal, rather than circumferential. The combustion fluid pattern is at least as long as the pin joint, and in practice extends both above and below the pin joint.

Figure 3:
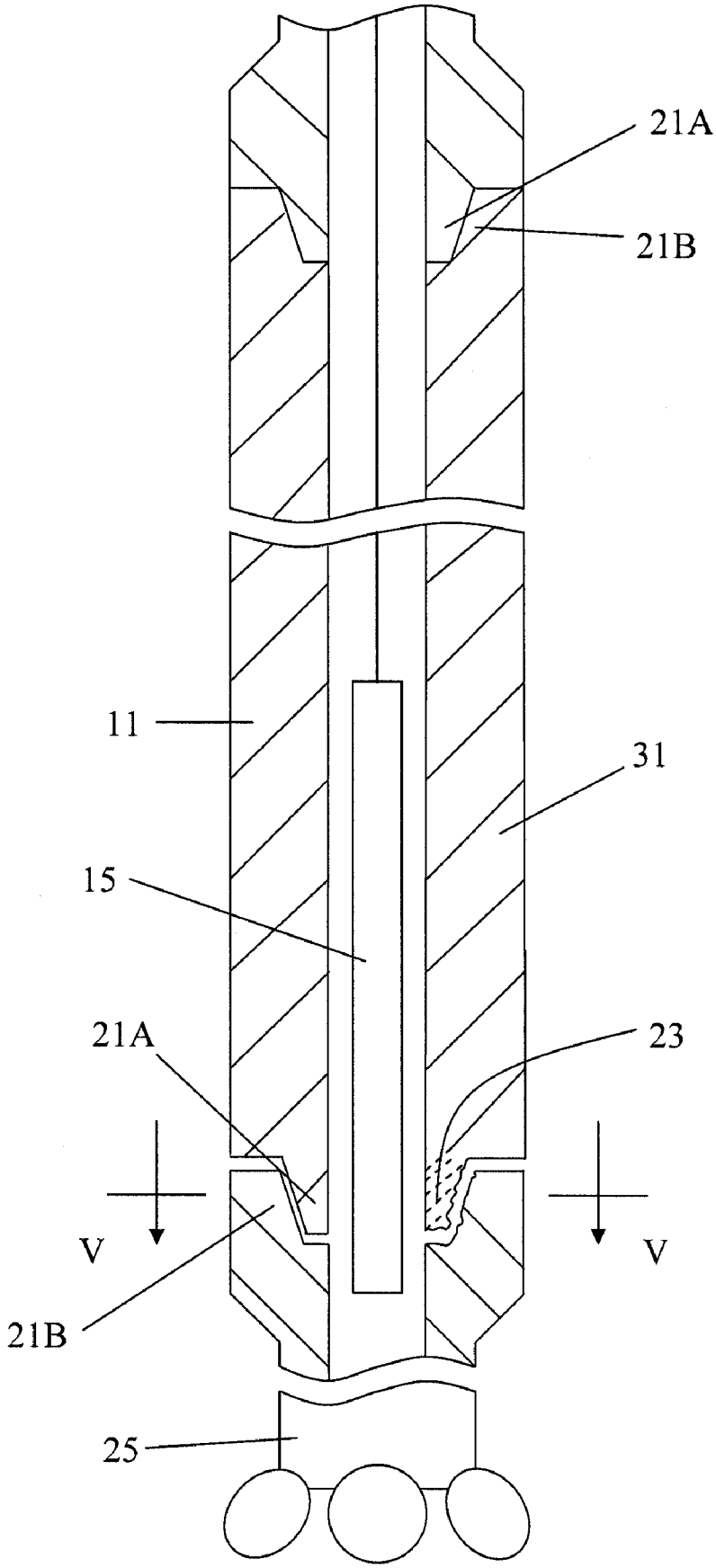
FIG. 3 shows the drill collar of FIG. 1, having been cut and separated.
Figure 5:
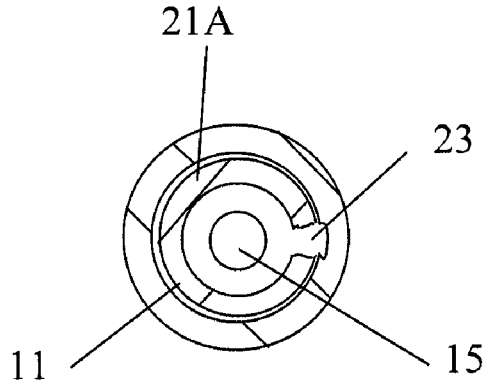
FIG. 5 is a cross-sectional view of FIG. 3, taken along lines V-V.

The torch creates a cut 23 along the longitudinal axis in the pin joint 21A (see FIGS. 3 and 5). The pin 21A is severed. The portions of drill collar above and below the pin joint have longitudinal cuts therein, but due to the wall thickness, these cuts do not extend all the way to the outside. FIG. 5 shows the cut extending part way into the corresponding box joint. Thus, the box joint and the portions of the drill collar above and below the pin joint are not cut completely through and are unsevered. Nevertheless, when the pin joint is cut, it unwinds or springs open. The joint decouples and the drill string becomes severed at the joint. Thus, only the pin joint need be cut to sever the drill collar. That portion of the drill string that is unstuck, the upper portion, is retrieved to the surface.

Figure 8A:
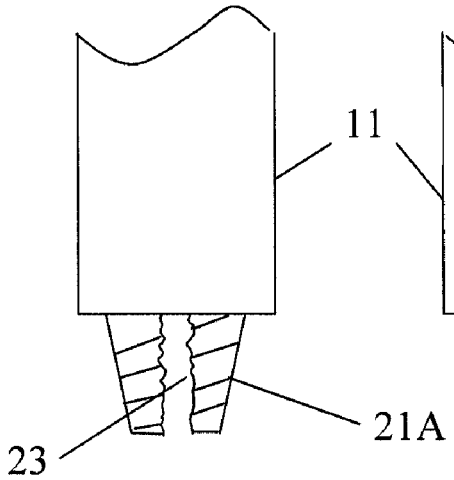
FIGS. 8A-8C show the dressing of a cut end of a drill collar to form a new pin joint.
Figure 8B:
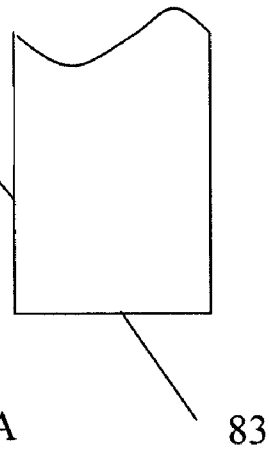
Figure 8C:
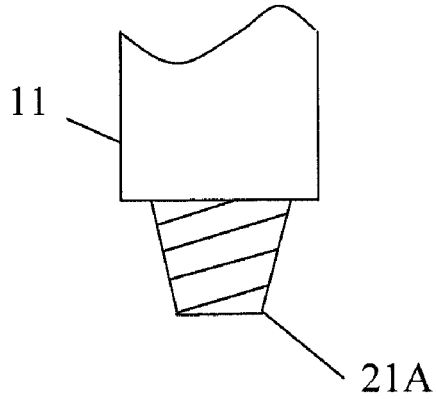

The drill collar 11 that was cut at its pin joint can be reused. Referring to FIG. 8A, the pin joint 21A has a longitudinal cut 23 therein. The pin joint 21A is cut off of the drill collar, as well as any damaged portions of the collar to form a clean end 83 (see FIG. 8B). The end 83 is remachined to form a new pin joint (see FIG. 8C). The drill collar can now be reused.

Each of the torches can be provided with ancillary equipment such as an isolation sub and a pressure balance anchor. The isolation sub typically is located on the upper end of the torch and protects tools located above the torch from the cutting fluids. Certain well conditions can cause the cutting fluids, which can be molten plasma, to move upward in the tubing and damage subs, sinker bars, collar locators and other tools attached to the torch. The isolation sub serves as a check valve to prevent the cutting fluids from entering the tool string above the torch.

The pressure balance anchor is typically located below the torch and serves to stabilize the torch during cutting operations. The torch has a tendency to move uphole due to the forces of the cutting fluids. The pressure balance anchor prevents such uphole movement and centralizes the torch within the tubing. The pressure balance anchor has either mechanical bow spring type centralizers or rubber finger type centralizers.

The foregoing disclosure and showings made in the drawings are merely illustrative of the principles of this invention and are not to be interpreted in a limiting sense.

The invention claimed is:

1. A method of severing a drill collar string comprising the steps of:

a) lowering a torch into the drill collar string;

b) positioning the torch at a joint in the drill collar string, wherein the joint comprises a pin component on an inside diameter and a box component on an outside diameter;

c) igniting the torch to produce cutting fluids;

d) directing the cutting fluids into the joint in a direction that is along the length of the drill collar string to cut the joint and allow the joint to unwind; and e) severing the pin component while leaving the box component unsevered.

2. The method of claim 1, wherein the step of positioning the torch at a joint in the drill collar string further comprises the step of positioning cutting fluid openings of the torch at the joint.

3. The method of claim 1, wherein the step of positioning the torch at a joint in the drill collar string further comprises the step of producing a pattern of cutting fluids, the pattern having a length at least as long as the joint.

4. The method of claim 1 further comprising the step of removing from the borehole the portion of the cut drill collar string that is above the cut joint.

5. The method of claim 4 further comprising the step of redressing the cut end of the drill collar with the cut joint so as to make a new, uncut joint.

6. The method of claim 1, wherein:

a) the step of positioning the torch at a joint in the drill collar string further comprises the step of positioning the cutting fluid openings of the torch at the joint; and the step of directing the cutting fluids into the joint further comprises the step of producing a pattern of cutting fluids, the pattern having a length at least as long as the joint.

* * * * *